United States Patent [19]

Shimoyama et al.

[11] Patent Number: 5,044,794

[45] Date of Patent: Sep. 3, 1991

[54] INK RIBBON CASSETTE

[75] Inventors: Noboru Shimoyama; Yasuo Ohba, both of Yokohama, Japan

[73] Assignee: Canon Kabushiki Kaisha, Tokyo, Japan

[21] Appl. No.: 352,698

[22] Filed: May 10, 1989

Related U.S. Application Data

[63] Continuation of Ser. No. 62,672, Jun. 16, 1987, abandoned.

[30] Foreign Application Priority Data

| | | | |
|---|---|---|---|
| Apr. 25, 1987 | [JP] | Japan | 62-102456 |
| Apr. 25, 1987 | [JP] | Japan | 62-102457 |
| Apr. 25, 1987 | [JP] | Japan | 62-102458 |
| Apr. 25, 1987 | [JP] | Japan | 62-102462 |

[51] Int. Cl.[5] ..... B41J 35/28

[52] U.S. Cl. ..... 400/208; 242/192; 400/228; 400/236

[58] Field of Search ..... 400/207, 208, 208.1, 400/228, 229, 235, 236, 194, 195, 196, 196.1; 242/192

[56] References Cited

U.S. PATENT DOCUMENTS

| | | | |
|---|---|---|---|
| 3,618,869 | 11/1971 | Cialone | 400/236 X |
| 4,010,839 | 3/1977 | Guerrini et al. | 400/207 |
| 4,302,118 | 11/1981 | Schaefer | 400/228 X |
| 4,329,073 | 5/1982 | Craft | 400/208 |
| 4,367,052 | 1/1983 | Steger | 400/228 X |
| 4,623,272 | 11/1986 | Kondo | 400/196.1 X |

FOREIGN PATENT DOCUMENTS

| | | | |
|---|---|---|---|
| 0378510 | 5/1978 | Austria . | |
| 0041095A1 | 12/1981 | European Pat. Off. . | |
| 2553329A1 | 5/1976 | Fed. Rep. of Germany . | |
| 2951610 | 7/1981 | Fed. Rep. of Germany | 400/196.1 |
| 1585245 | 2/1981 | United Kingdom . | |

*Primary Examiner*—Edgar S. Burr
*Assistant Examiner*—Moshe I. Cohen
*Attorney, Agent, or Firm*—Fitzpatrick, Cella, Harper & Scinto

[57] ABSTRACT

An ink ribbon cassette includes a supply side ribbon spool, a take-up side ribbon spool, a cassette case containing therein the supply side and take-up side ribbon spools and pivotably supporting at least the take-up side ribbon spool through a lever member and having an opening through which an outside feed tooth may mesh with the take-up side ribbon spool. A support portion provided in the opening for contacting the peripheral surface of the take-up side ribbon spool prevents the take-up side ribbon spool from protruding outwardly, and a biasing device impart a rotational force to the lever member so that the take-up side ribbon spool is urged against the support portion.

16 Claims, 15 Drawing Sheets

INK RIBBON CASSETTE

This application is a continuation of application Ser. No. 062,672 filed June 16, 1987 now abandoned.

BACKGROUND OF THE INVENTION

1. Field of the Invention

This invention relates to an ink ribbon cassette adapted to be removably mounted with respect to a recording apparatus such as a printer and to contain an ink ribbon therein.

2. Related Background Art

Generally, an ink ribbon cassette contains therein a supply side ribbon spool and a take-up side ribbon spool for winding an ink ribbon thereon. There are available ink ribbon cassettes in which the take-up side ribbon spool is movable.

A ribbon cassette in which a take-up spool is movable is shown in FIGS. 15A and 15B of the accompanying drawings. In these figures, a ribbon 101 drawn out from a supply ribbon spool 100 is exposed outwardly and again introduced into the cassette, and then wound onto a take-up ribbon spool 102. The take-up spool 102 is rotatably supported on one end of a support arm 103. The other end of the support arm 103 is biased in the direction of arrow L with a force G by a coil spring 104.

The take-up spool 102 biased in the direction of arrow L is moved toward an opening 105 formed in a wall surface of the ribbon cassette. The take-up spool 102 thus moved strikes against a side wall 106 of the opening 105 and is stopped thereby.

On the other hand, when feeding of the ink ribbon is to be effected, a feed tooth 107 on the recording apparatus side is moved in the direction of arrow M to push back the take-up spool 102 in the direction opposite to the direction L against the force of a spring 104 and separate the take-up spool 102 from the side wall 106. In this state, the feed tooth 107 is rotated by a drive source, not shown, to take up the take-up spool 102.

On the other hand, when take-up is not effected, the take-up spool 102 is in contact with the side wall 106, as previously described. FIG. 16 of the accompanying drawings shows such state, and the take-up spool 102 is in contact with the side wall 105 by a surface 108.

If the take-up spool is left in the state of FIG. 16 for a long time, a stepped portion 109 is longitudinally formed on the surface of the take-up spool 102 as shown in FIG. 17 of the accompanying drawings. This is because the ink ribbon on the spool 102 is dented. The presence of such a stepped portion 109 would cause tooth skip or the like when an attempt is made to rotate the take-up spool by the feed tooth 107, thus resulting in inaccurate take-up of the ribbon.

Further, when the force applied between the take-up spool 102 and the side wall 106 is considered, there are numerous disadvantages.

These will now be described with reference to FIGS. 18 and 19 of the accompanying drawings.

FIG. 18 shows the start of the take-up of the take-up spool 102, and FIG. 19 shows the course of the take-up of the take-up spool 102. The significances of symbols shown in the figures are as follows:

$r_n$: radius of the ink ribbon $G_n$: spring force $G'_n$: spring force in the direction of the normal which acts on side wall 106

$P_n$: reaction force received by take-up spool 102

$\beta_n$: the angle between the directions in which Gn and G'n act n=1: initial stage n=n: take-up is going on n=f: end of take-up l: distance from side wall 106 to a straight line lying on the same axis as the direction in which the spring force acts Now, from FIG. 19, $$\begin{cases} \sin\beta_n = \dfrac{l}{r_n} & (1) \\ G'_n = G_n \cos\beta_n & (2) \end{cases}$$

$\beta$n is eliminated from (1) and (2), and thus, $$G'_n = G_n\sqrt{1-\left(\frac{l}{r}\right)^2} \quad (3)$$

$G'_n$ is equal in absolute value to $P_n$ which is the reaction force the ink ribbon receives from the side wall 106, and this reaction force serves to regulate the ink ribbon wound on the take-up spool 102 so that the ink ribbon does not become slack. Further, generally, $$P_1 \leqq P_n \quad (7)$$

and therefore, $P_1$ is the minimum necessary reaction force for preventing the slack of the take-up spool.

From the foregoing, $G_n$ and $P_n$ may be graphically shown as in FIG. 14 of the accompanying drawings. As is apparent from FIG. 14, when the turn radius of the take-up spool 102 is minimum, the component $G'_1$ of the spring force $G_1$ in the direction toward the side wall 106 is diminished to about one half of $G_1$. This is because the side wall 106 contacts the take-up spool 102 not at the central point 110 of the take-up spool 102 but at a point off the central point 110. If $G'_1$ thus becomes small as compared with $G_1$, $G_1$ itself must be made great to sufficiently satisfy the minimum reaction force $P_1$ necessary for preventing the slack of the take-up spool 102. For this reason, in the prior art, use had to be made of a spring 104 of very great spring constant.

The use of such a spring of great spring constant to bias the take-up spool 102 unavoidably leads to the necessity of increasing the strength of the entire ribbon cassette, which in turn leads to an increased cost. There is also a danger that movement of the take-up spool 102 cannot be accomplished smoothly.

Also, in this example of the prior art, the spring force $G_n$ is applied in the same direction as the direction of movement of the take-up spool 102 and therefore, $G_n$ increases in proportion to the increase in the turn radius of the take-up spool 102. If $G_n$ thus increases in proportion to the amount of turns, when the feed tooth 107 eats into the take-up spool 102 during the feeding of the ribbon, the eat-in force will become greatly irregular depending on the turn radius of the take-up spool 102. If this eat-in force becomes irregular, the amount of eat-in of the feed tooth will vary, thus causing a disadvantage that the amount of feed of the ribbon varies depending on the turn radius of the take-up spool.

Further, as the turn radius increases, the angle $\beta_n$ between $G_n$ and $G'_n$ decreases. Thus $G'_n/G_n$ gradually increases as the turn radius increases.

For this reason, as can be seen from FIG. 14, the reaction force $P_n$ the take-up spool 102 receives from the side wall 106 sharply increases due to the increase in the turn radius. Such a sharp increase in $P_n$ is not preferable because it remarkably expedites the formation of the stepped portion 109 shown in FIG. 17.

FIG. 20 of the accompanying drawings shows another example of the prior art. A supply side ribbon spool 201 and a take-up side ribbon spool 202 are contained in a cassette 200. Reference numerals 203 and 204 designate manually rotatable knobs. Feeding of the ribbon can be accomplished by holding these knobs.

FIG. 21 of the accompanying drawings shows a cross-section taken along line XX—XX of FIG. 20. The take-up side ribbon spool 202 comprises a take-up core 205 and an ink ribbon wound thereon, and the manually rotatable knob 204 is formed above and integrally with the core 205. Such integral formation of the knob 204 with the core 205 is preferable in that the number of parts is reduced.

However, if the knob 204 is formed integrally with the core 205, the diameter 207 of the knob 204 must be made smaller than the diameter 208 of a hole 206 for the purpose of assembly. Such a smaller diameter of the knob 204 leads to great difficulties in operation.

FIG. 22 of the accompanying drawings shows still another example of the prior art.

Recently, the amount of ink ribbon used has been increased, and this leads to the tendency of the ribbon cassette 300 toward bulkiness.

Such bulkiness of the cassette in turn leads to great difficulties in holding the cassette.

The bulkiness of the cassette also leads to the corresponding bulkiness of a ribbon feeding device 301, and this is not preferable.

SUMMARY OF THE INVENTION

It is an object of the present invention to provide an ink ribbon cassette which is effective to improve operability and realize compactness and reduced cost.

It is another object of the present invention to better the take-up property in an ink ribbon cassette wherein a take-up spool is movable.

It is still another object of the present invention to prevent a stepped portion formed on a take-up spool from adversely affecting the take-up in an ink ribbon cassette wherein the take-up spool is movable.

It is yet still another object of the present invention to improve the operability of a manually rotatable knob portion and achieve a reduction in cost.

It is a further object of the present invention to improve the ease with which the cassette is held by hand and enable the recording apparatus also to be compact.

Other objects of the present invention will become apparent from the following detailed description when read in conjunction with the accompanying drawings.

DESCRIPTION OF THE PREFERRED EMBODIMENTS

Figure 1:
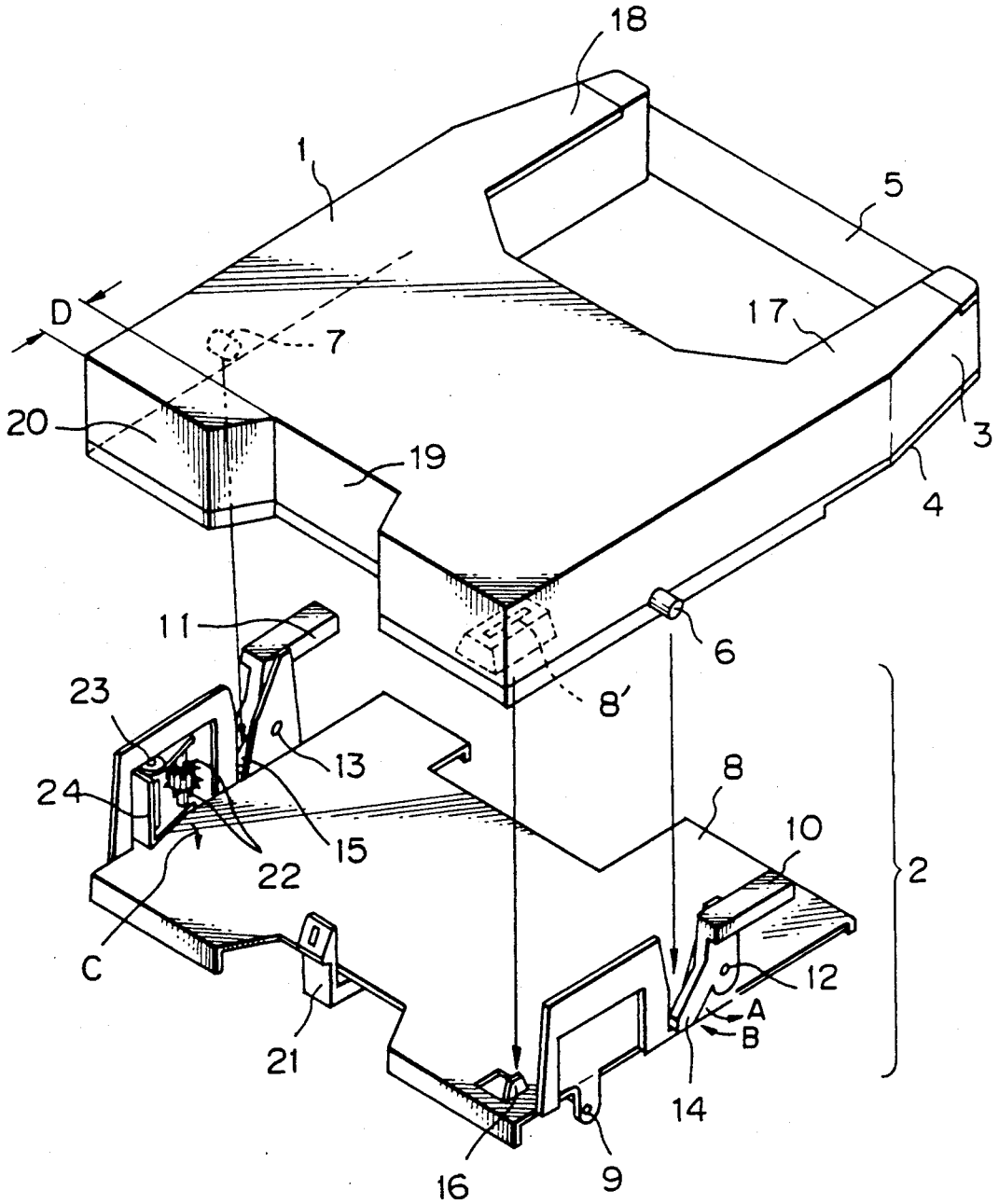
FIG. 1 is a perspective view showing the whole of an embodiment of the present invention.

FIG. 1 is a perspective view showing the whole of an embodiment of the present invention. Reference numeral 1 designates a ribbon cassette removably mounted on a ribbon feeding mechanism designated by 2. The ribbon cassette 1 is comprised of an upper case 3 and a lower case 4, and is of a construction in which an ink ribbon 5 is exposed at the fore end of the cassette.

Positioning of the entire ribbon cassette 1 may be accomplished by positioning bosses 6, 7 and a positioning slit 8'. The ribbon feeding mechanism 2 is formed on the carriage of a printing apparatus, not shown, and is supported so that on the carriage, a mounting bed 8 is pivotable about a pivot fulcrum 9. Reference numerals 10 and 11 denote mounting and dismounting levers for stopping the positioning bosses 6 and 7 of the ribbon cassette. The mounting and dismounting levers 10 and 11 are supported for pivotal movement in a direction A or a direction B by pivot shafts 12 and 13, respectively. The mounting and dismounting levers 10 and 11 are biased for pivotal movement in the direction B by a spring, not shown.

Accordingly, if the ribbon cassette is depressed downwardly as shown, the stop pawls 14 and 15 of the mounting and dismounting levers 10 and 11, respectively, will be depressed and pivoted in the direction A by the positioning bosses 6 and 7.

When the ribbon cassette is sufficiently depressed, the mounting and dismounting levers 10 and 11 are returned in the direction B by the force of a spring and stop the positioning bosses 6 and 7 by the stop pawls 14 and 15, respectively. At this time, a positioning pawl 16 fits in the positioning slit 8' of the ribbon cassette and thus, the ribbon cassette is positioned and fixed relative to the mounting bed 8. A recess 19 is formed in the rear surface of the ribbon cassette, i.e., the surface thereof which is opposite to guide arms 17 and 18.

The distance of the recess 19 from the rear surface 20 is D, and an index mark 21 on the mounting bed 8 fits into the recess 19. Since the recess 19 is thus recessed by D from the rear surface 20, the index mark 21 on the mounting bed 8 can be advanced by the distance D and disposed in the recess. Thus, the shape of the mounting bed 8 is made compact.

Reference numeral 22 designates a feed tooth for feeding the ink ribbon and is of a double-tooth construction. The feed tooth 22 is rotatably supported on an arm 24 pivotable about a pivot shaft 23. When the ribbon cassette is mounted, the arm 24 is pivoted in a direction C by a drive source, not shown. Accordingly, a take-up spool in the ribbon cassette and the feed tooth 22 mesh with each other through an opening as will be described later. The rotational force of the feed tooth 22 is provided by a drive source, not shown.

Figure 2:
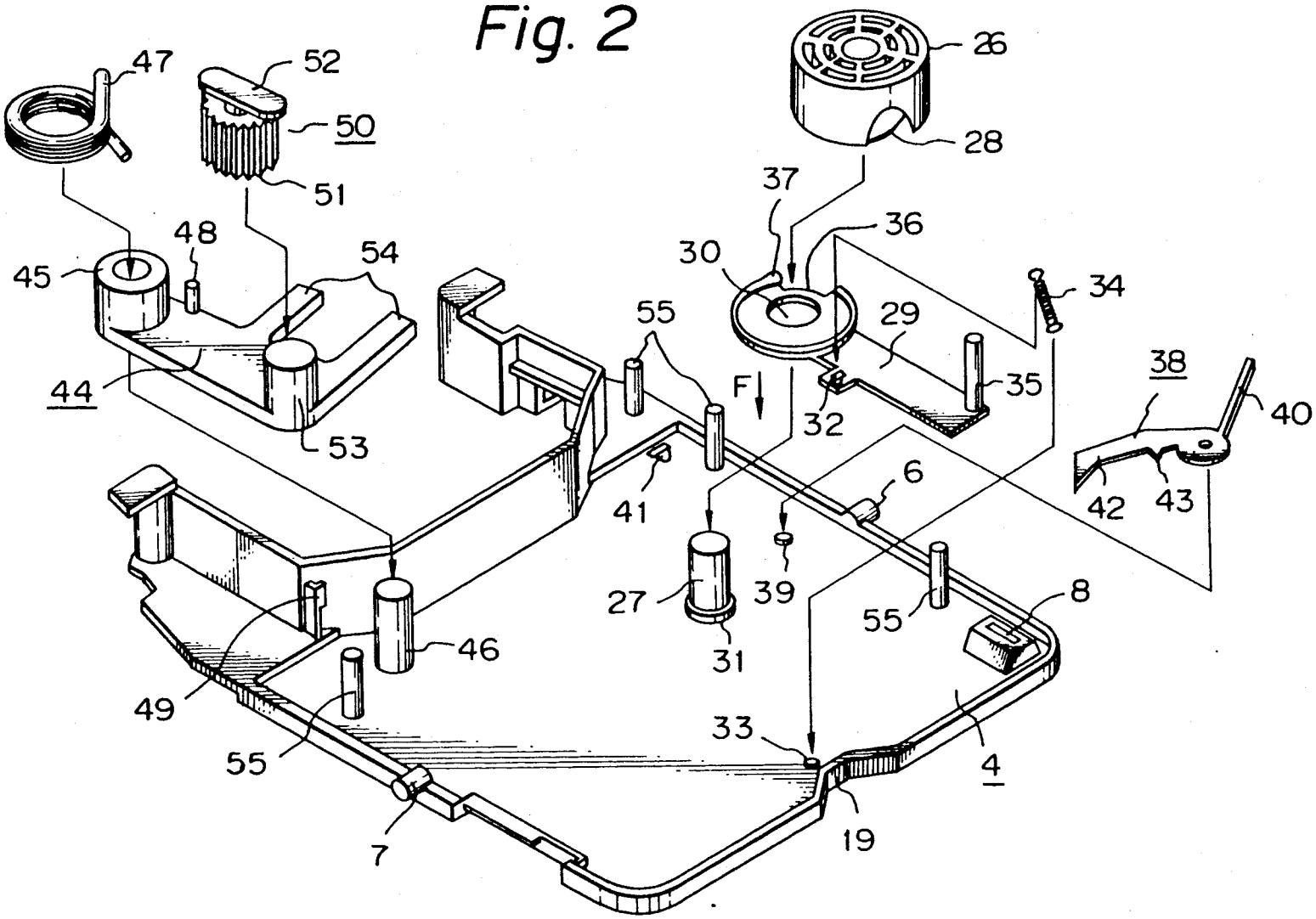
FIG. 2 is an exploded view of a ribbon cassette with the upper case thereof removed.

FIG. 2 shows the details of the ribbon cassette. In FIG. 2, the upper case 3 is removed. Reference numeral 26 designates a supply core having the ink ribbon wound on the peripheral surface thereof and rotatably supported on a support shaft 27 projected from the lower case 4. A knurled portion 28 is formed on the lower portion of the supply core 26.

Denoted by 29 is a tension lever which is pivotally supported on the support shaft 27 by the central hole 30 thereof being fitted over the support shaft 27. In the mounted state of the ribbon cassette, the tension lever 29 and supply core 26 are mounted on the support shaft 27 in the named order, and positioning of the supply core 26 in a direction F is accomplished by a seat 31.

A coil spring 34 is provided between the boss 32 of the tension lever 29 and the boss 33 of the lower case 4 to bias the tension lever clockwise as viewed in FIG. 2. A guide pin 35 is projectedly provided on the tip end of the tension lever 29, and tension is imparted to the ink ribbon by guiding the ink ribbon by the guide pin 35. A cut-away portion 36 is formed around the central hole 30 of the tension lever 29, and in the mounted state of the ribbon cassette, the knurled portion 28 of the supply core 26 protrudes from the cut-away portion 36.

A convex portion 37 is formed adjacent to the cut-away portion 36. Designated by 38 is a lock pawl rotatably supported on a pivot boss 39 formed on the lower case 4. In its mounted state, a spring portion 40 which is a part of the lock pawl 38 is fixed to the stop portion 41 of the lower case 4, and acts to bias the lock pawl 38 counterclockwise as viewed in FIG. 2.

A guide portion 42 is formed on the tip end of the lock pawl and is urged against the convex portion 37 of the tension lever 29 by the force of the spring portion 40. A pawl portion 43 is formed at the center of the lock pawl 38 and meshes with the knurled portion 28 of the supply core 26.

Denoted by 44 is a take-up lever which is pivotally supported on the lower case 4 by a cylindrical portion 45 being fitted to the rotary shaft 46 of the lower case 4. Reference numeral 47 designates a torsion coil spring wound on the cylindrical portion 45 and having one end thereof stopped by the stop portion 48 of the take-up lever 44 and having the other end stopped by the stop portion 49 of the lower case 4. The take-up lever 44 is biased clockwise as viewed in FIG. 2 by the force of the torsion coil spring 47.

Reference numeral 50 denotes a take-up core integrally having a take-up portion 51 for taking up the ribbon and a manually rotatable knob 52 for manually taking up the ribbon. The take-up core 50 is rotatably supported on a support shaft 52 formed at the tip end of the take-up lever 44. A ribbon supporting portion 54 for supporting the underside of the ribbon spool is formed at the tip end of the take-up lever 44.

In FIG. 2, reference numeral 55 designates a guide pin formed integrally with the lower case 4 to guide the ink ribbon.

Figure 3:
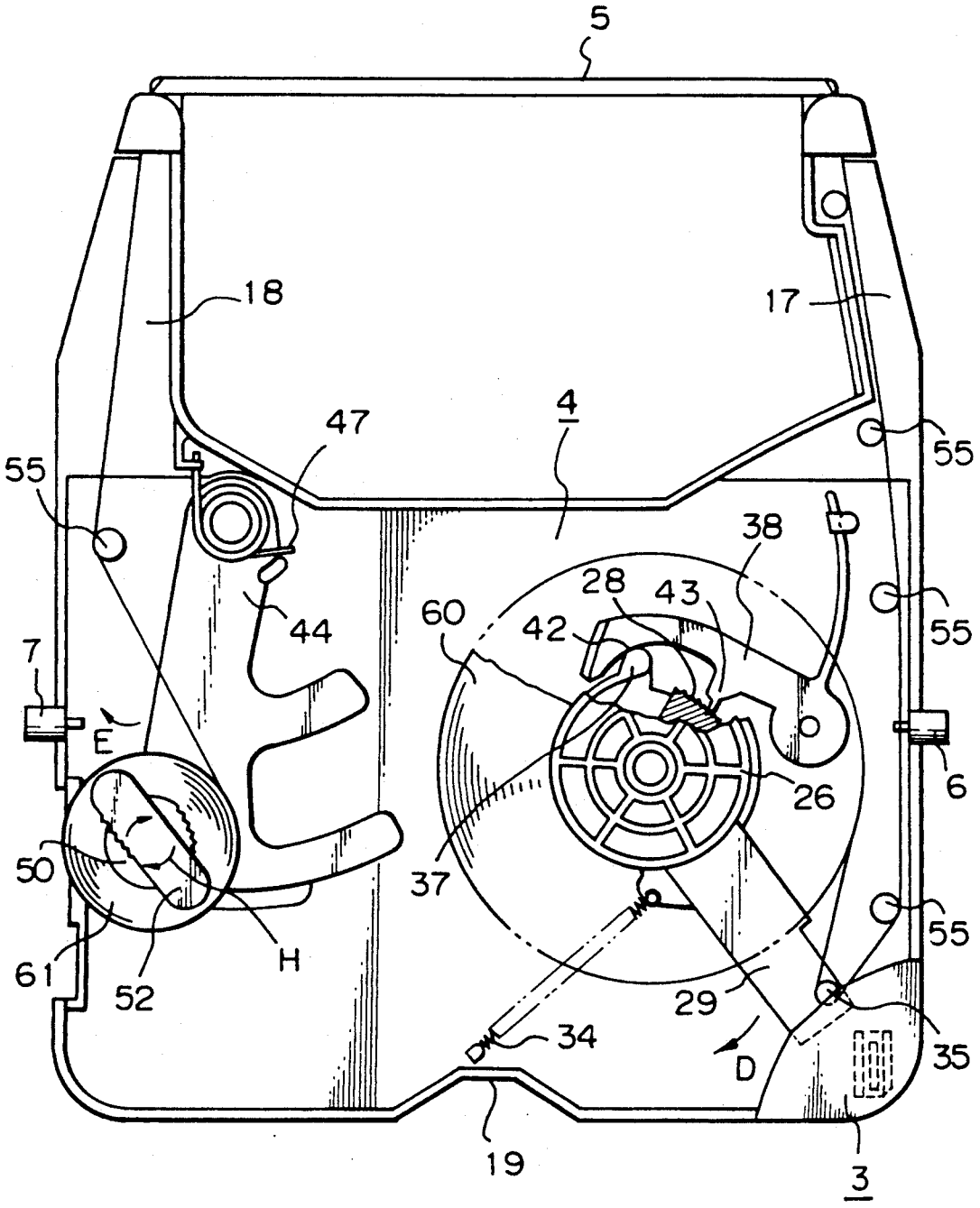
FIG. 3 is a plan view of the ribbon cassette with the upper case thereof partly broken away.

FIG. 3 shows the ribbon cassette with the upper case thereof partly broken away. As shown, the ink ribbon drawn out from a supply spool 60 comprising the ink ribbon wound around the supply core 26 is guided by the guide pin 35 and is led outwardly past the guide arm 17 via the guide pin 55.

The exposed ink ribbon is again led into the ribbon cassette through the guide arm 18 and is taken up by the take-up core 50 via the guide pin 55, thus forming a take-up spool 61. As shown, the tension lever 29 is normally biased in a direction D by the coil spring 34. Thus, tension is imparted to the ink ribbon.

In this state, as the ink ribbon is drawn out the tension lever 29 is rotated in the direction opposite to the direction D because the knurled portion 28 of the supply core 26 is stopped by the pawl portion 43 of the lock pawl 38. This operation in the direction opposite to the direction D results in the convex portion 37 pressing the guide portion 42 of the lock pawl 38, whereby the meshing engagement between the lock pawl 38 and the knurled portion 28 is released. When the meshing engagement between the pawl portion 43 and the knurled portion 28 is thus released, the supply core 26 becomes free to rotate so as to feed out the ribbon. Thereby the tension lever 29 is rotated in the direction D and stops at a predetermined position. By the movement of the tension lever as described above, the ink ribbon is fed sequentially.

On the other hand, the take-up spool 61 has its side engaged by the feed tooth 22 shown in FIG. 1 and is taken up sequentially. At this time, the meshing force between the feed tooth 22 and the take-up spool 61 is provided by the tension coil spring 47. Accordingly, the take-up lever 44 is normally biased in a direction E and the spool 61 is taken up in a direction H by the force of the feed tooth.

By an increase in the amount of turns of the take-up spool 61, the take-up lever 44 is pivoted in the direction opposite to the direction E. The state in which the take-up spool 61 is not in meshing engagement with the feed tooth 22 is shown in FIG. 4.

Figure 4:
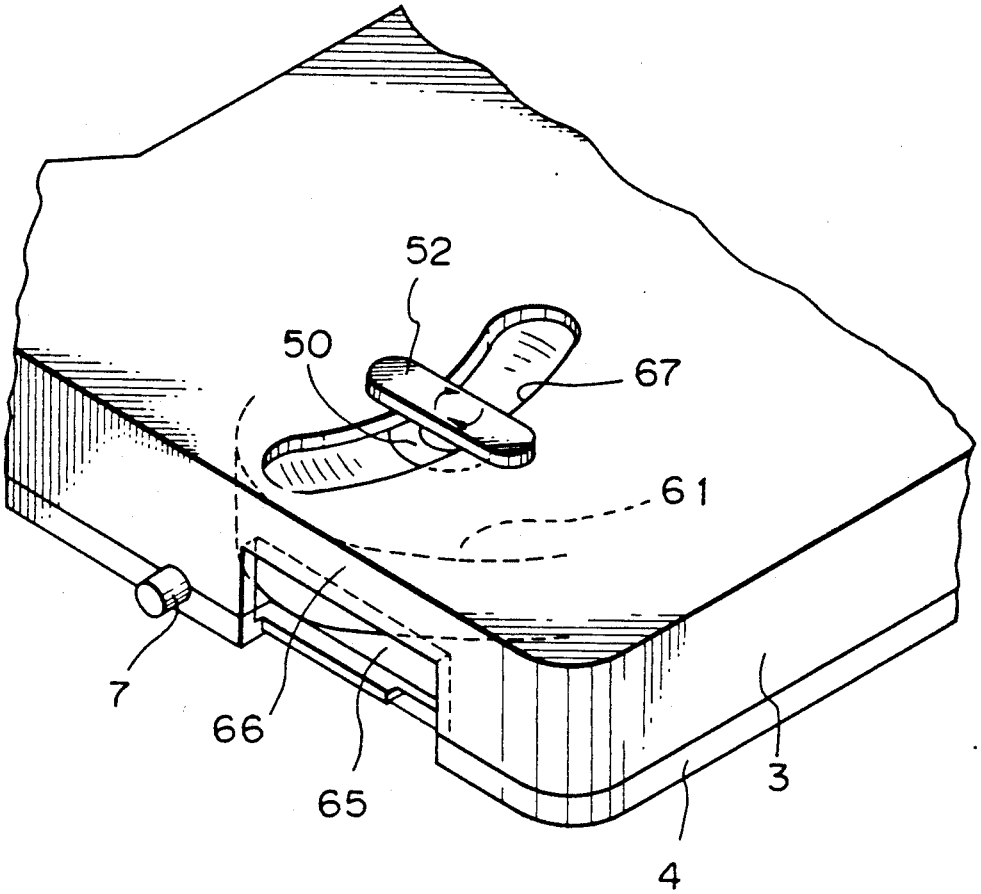
FIG. 4 illustrates the vicinity of an opening.

In FIG. 4, reference numeral 65 designates an opening through which the feed tooth 22 may mesh with the take-up spool 61. In the opening 65, there is formed a support wall 66 which contacts the upper end portion of the take-up spool 61 as viewed in the direction of the thickness thereof. This support wall 66 prevents the take-up spool 61 from being exposed outwardly through the opening 65.

On the other hand, an arcuate slot 67 is formed in the upper surface of the upper case 3. The manually rotatable knob 52 is exposed outwardly through this slot 67.

Figure 5:
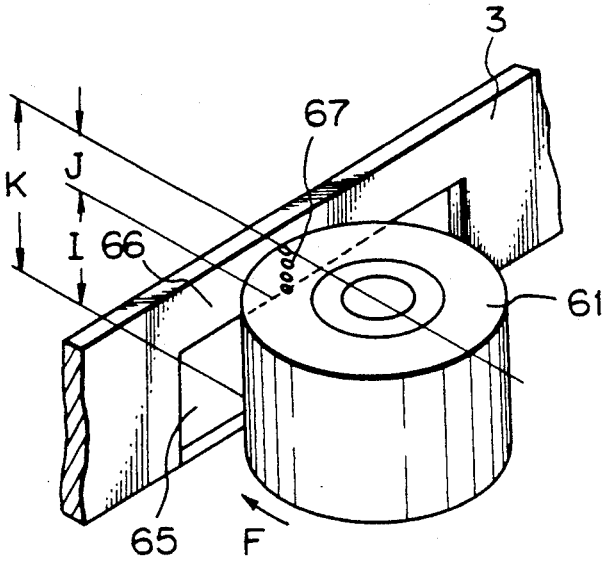
FIG. 5 illustrates the relation between a take-up spool and the opening.

FIG. 5 shows in detail the state in which the take-up spool 61 substantially perpendicularly contacts the supporting surface of the support wall 66.

The take-up spool 61 is urged against the support wall 66 by the force F of the torsion coil spring 47. The contact surface 67 of the spool 61 with respect to the support wall 66 has a length J in the direction of thickness of the spool 61. The entire width of the ribbon spool 61 is K, and the width of the take-up spool 61 which is exposed through the opening 65 is I.

Figure 6:
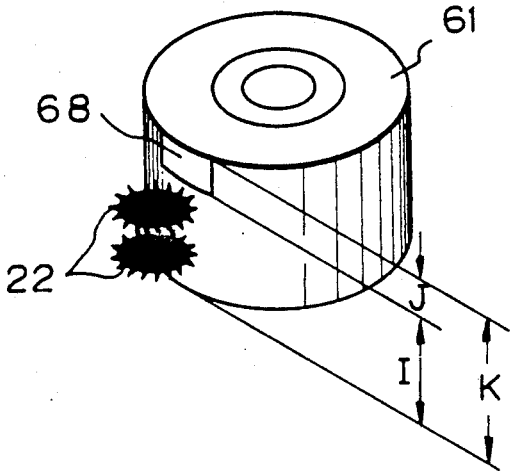
FIG. 6 illustrates the relation between the take-up spool and a feed tooth.

FIG. 6 shows the state after the take-up spool 61 has been left in the state of FIG. 5 for a long period of time. A stepped portion 68 is formed in the upper portion of the take-up spool 61. This stepped portion, however, is formed only in the upper portion of the take-up spool 61 in the direction of thickness thereof. The feed tooth 22 meshes with the take-up spool 61 in the area I and therefore, the stepped portion 68 hinders the feed of the ribbon in no way.

Figure 7:
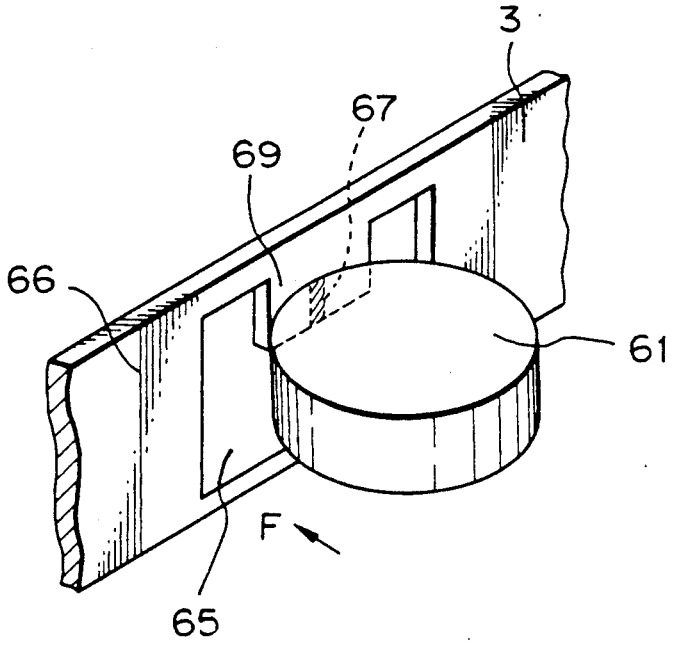
FIG. 7 illustrates another embodiment of the present invention.

FIG. 7 shows another embodiment of the support wall 66. In this embodiment, the support wall 69 is formed in a convex shape.

Figure 8:
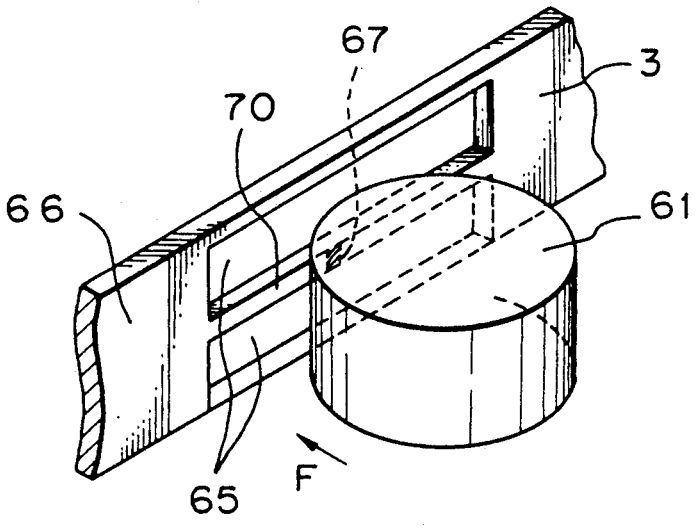
FIG. 8 illustrates still another embodiment of the present invention.

FIG. 8 shows still another embodiment of the support wall 66. In this embodiment, the support wall 70 is provided at a position whereat the contact surface 67 is formed at the center thereof in the direction of thickness of the take-up spool 61. The merit of the present embodiment is that the take-up spool 61 can be supported at the center thereof in the direction of thickness thereof. According to this, the moment force in the direction of thickness of the take-up spool can be eliminated.

Figure 9:
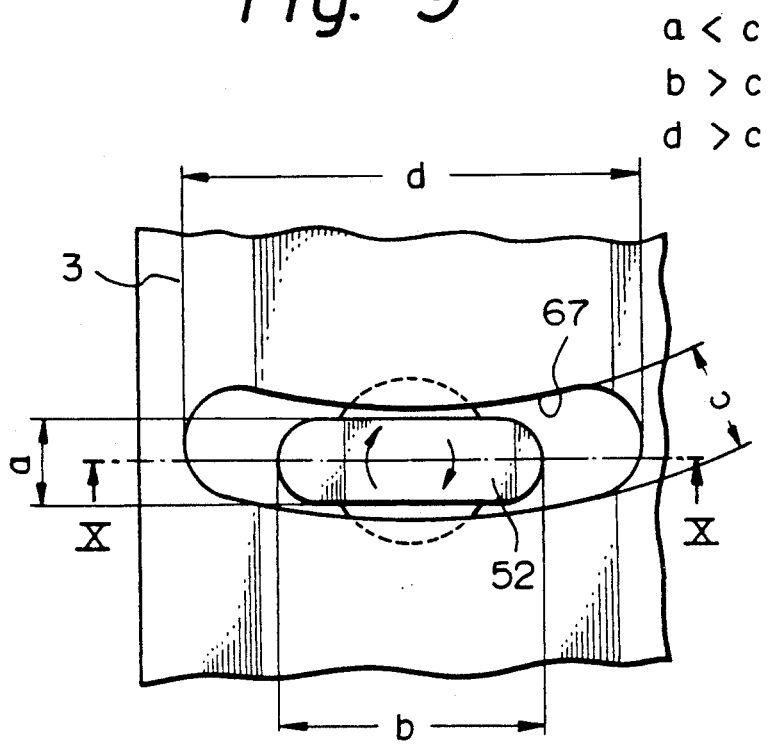
FIG. 9 illustrates the relation between a slot and a manually rotatable knob.

On the other hand, FIG. 9 shows the relation between the slot 67 and the manually rotatable knob 52 shown in FIG. 4. As shown, the slot 67 is formed in an arcuate shape having a shorter side c and a longer side d. The shorter side of the manually rotatable knob is a, and the longer side thereof is b. Here, a, b, c and d are in the relations that $a<c$, $b>c$ and $d>c$, and the manually rotatable knob 52 can be fitted at a particular position in the slot 67.

Figure 10:
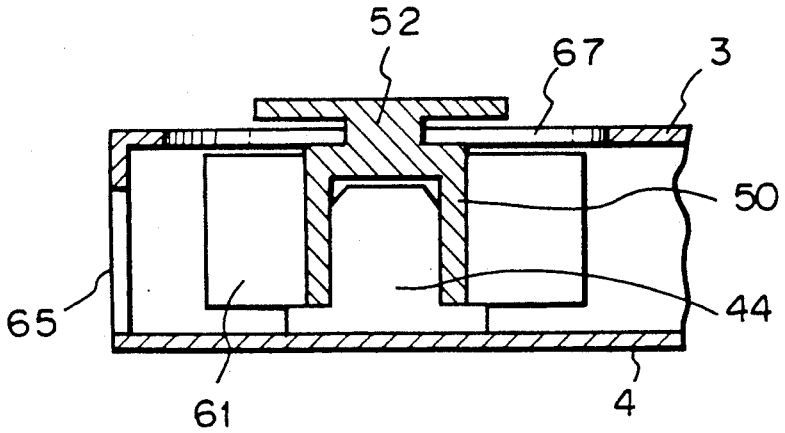
FIG. 10 is a cross-sectional view taken along line X—X of FIG. 9.

FIG. 10 shows a cross-section taken along line X—X of FIG. 9. As shown, the manually rotatable knob 52 can be easily fitted into the slot 67, and when the ribbon is to be taken up, the operability is high because the span b is sufficiently great.

Figure 11:
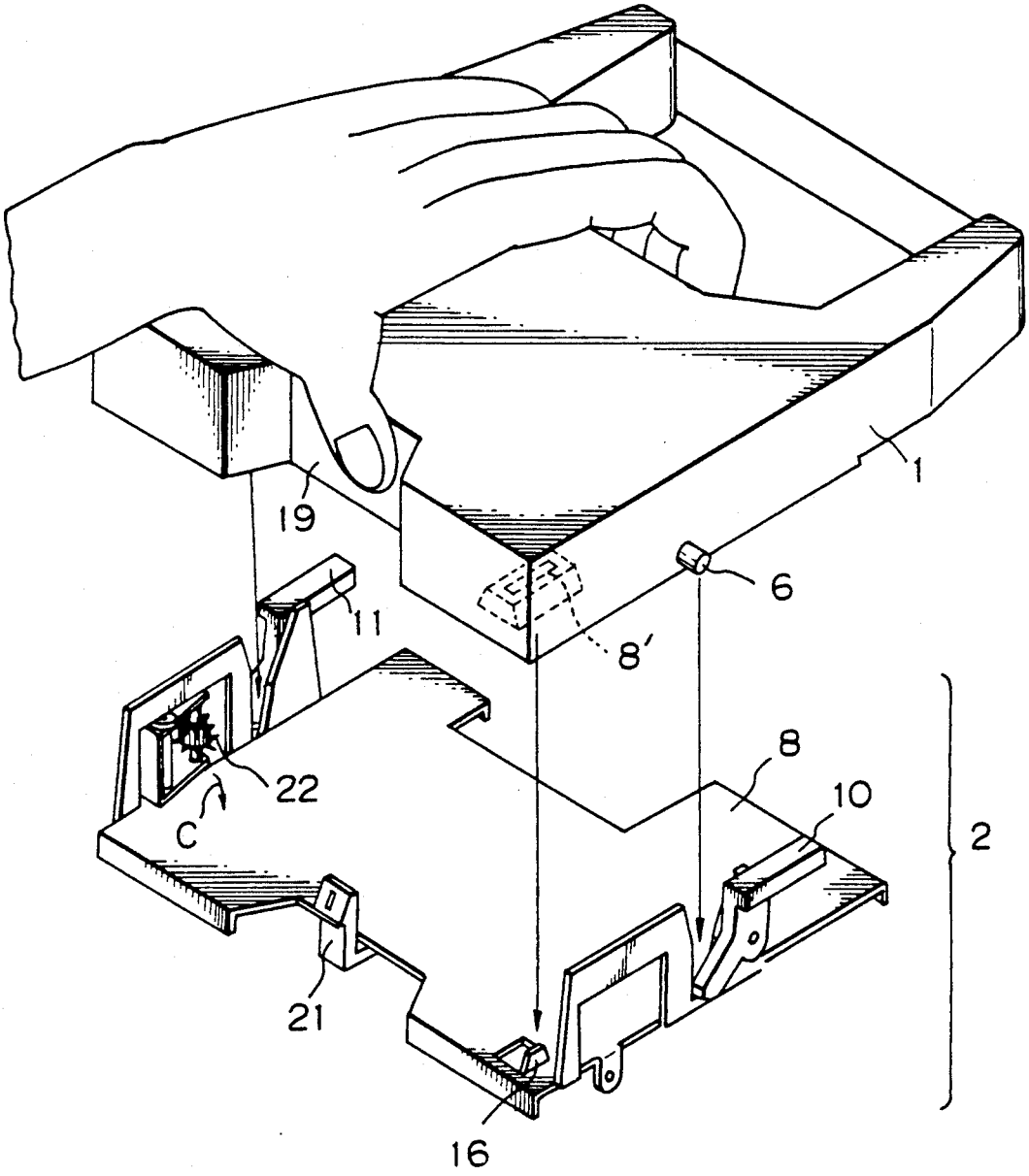
FIG. 11 illustrates the operation of mounting and dismounting the cassette.

FIG. 11 shows the manner in which the ribbon cassette 1 is mounted on the ribbon feeding mechanism 2.

As is apparent from FIG. 11, the operator can easily grasp the ribbon cassette 1 by holding the recess 19 thereof, and can readily mount it on the ribbon feeding mechanism.

On the other hand, the ribbon cassette 1 is such that when it is mounted on the ribbon feeding mechanism, the index mark 21 fits into the recess 19 of the cassette, and accordingly, the mounting bed 8 can be made smaller by an amount corresponding to the amount of recession of the recess 19.

Figure 12:
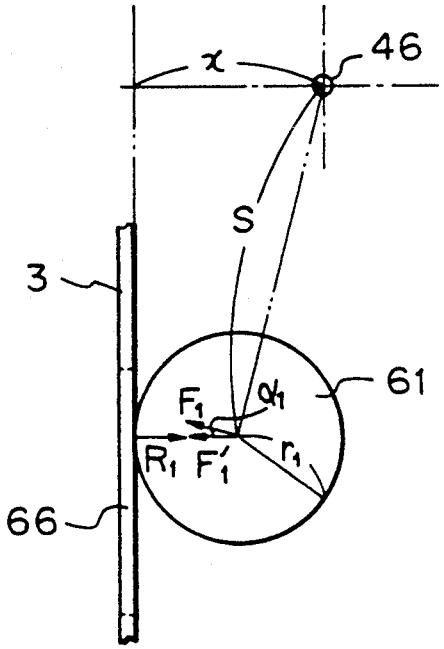
FIGS. 12 and 13 illustrate the relation between the take-up spool and a support wall.
Figure 13:
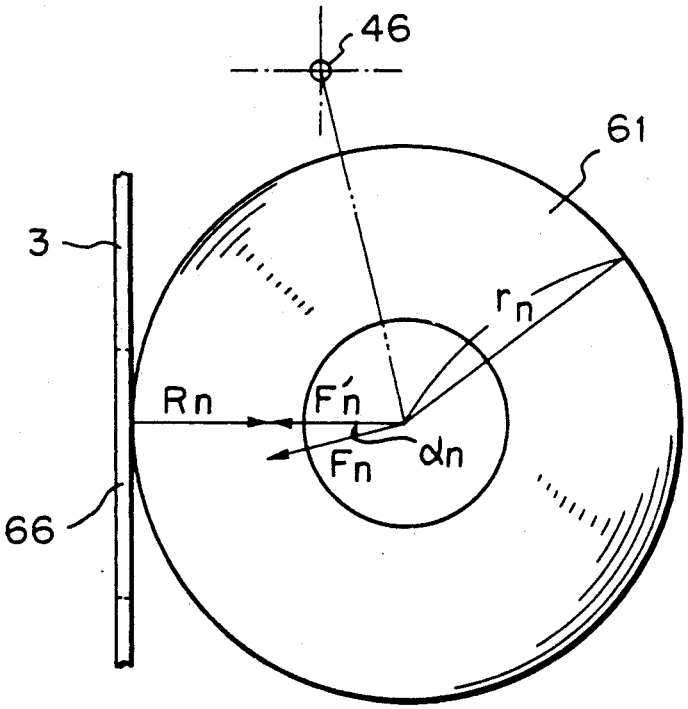

FIG. 12 shows the state in which the take-up of the take-up spool 61 has been started, and FIG. 13 shows the course of the take-up.

The significances of symbols in these figures are as follows:

$r_n$: radius of ink ribbon
n=1: initial stage
n=n: course of take-up
n=f: end of take-up
$F_n$: spring force of coil spring 47
$F'_n$: spring force in the direction of the normal acting on support wall 66
$R_n$: reaction force received by take-up spool 61
$\alpha_n$: the angle between the directions in which $F_n$ and $F'_n$ act
S: the distance from the center of rotation of take-up lever 44 to the center of rotation of the take-up spool on the take-up lever 44
X: the distance from supplement wall to a straight line which through the center of rotation of take-up lever 44 and perpendicularly intersecting the direction in which the reaction force acts From FIG. 13, $$\sin\alpha_1 = \frac{x - r_1}{S} \tag{4}$$

$$F_1' = F_1 \cos \alpha_1 \tag{5}$$

$\alpha_1$ is eliminated from equations (4) and (5) to obtain:

$$F_1' = F_1 \sqrt{1 - \left(\frac{x - r_1}{S}\right)^2} \tag{6}$$

Figure 18:
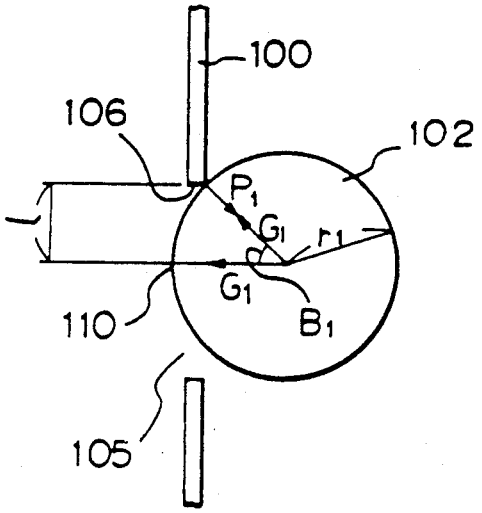
Fig. 18 PRIOR ART
FIGS. 18 and 19 illustrate the relation between an example of the prior-art take-up spool and the opening.
Figure 19:
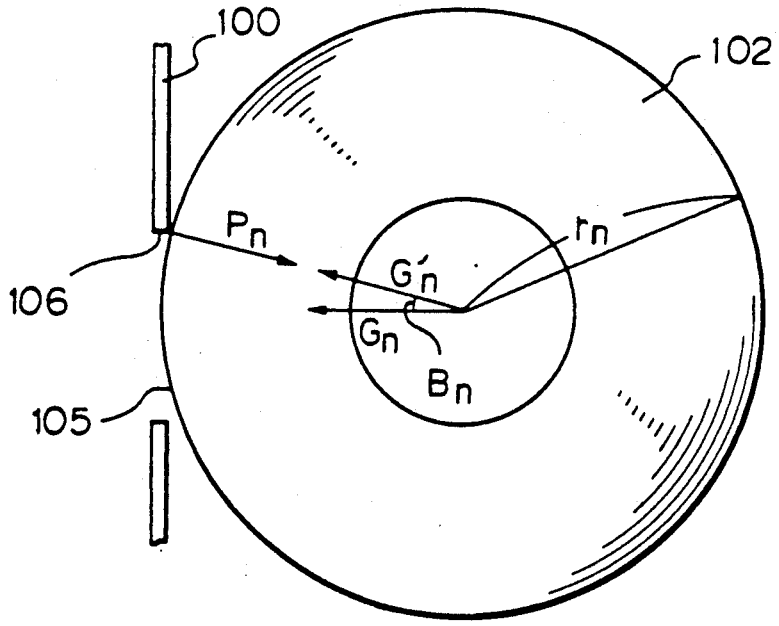
Fig. 19 PRIOR ART
Figure 20:
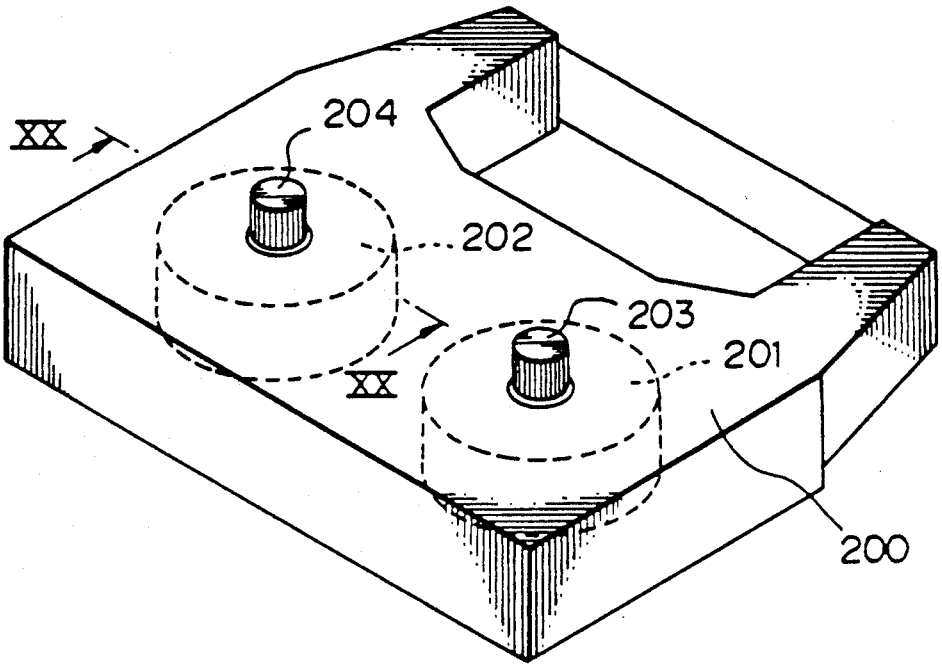
Fig. 20 PRIOR ART
FIG. 20 is a perspective view of another example of the prior art.
Figure 21:
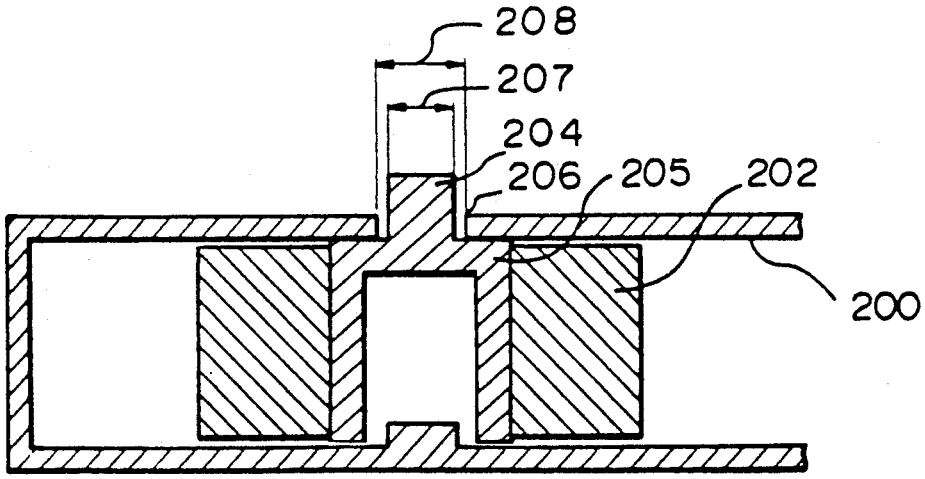
Fig. 21 PRIOR ART
FIG. 21 is a cross-sectional view taken along line XX—XX of FIG. 20.
Figure 22:
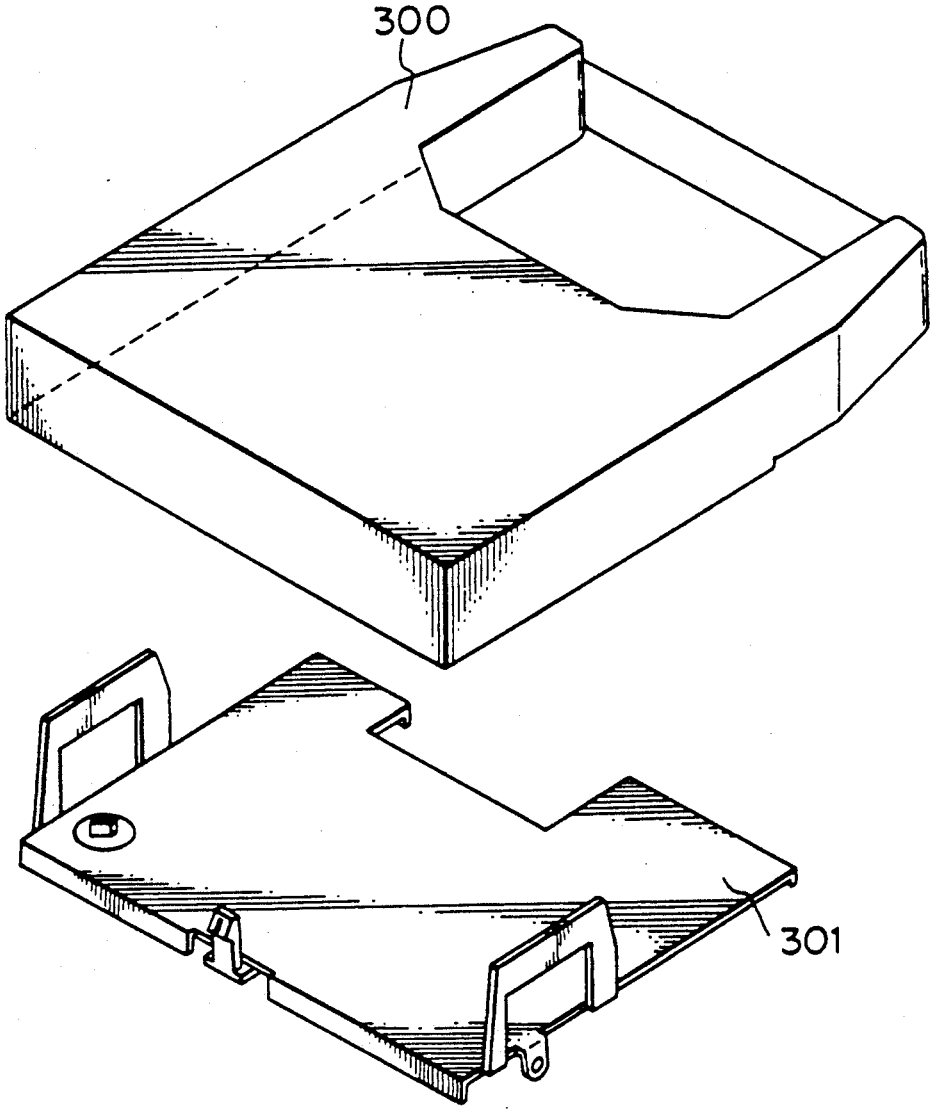
Fig. 22 PRIOR ART
FIG. 22 is an exploded perspective view of still another example of the prior art.

$F_n'$ is equal in absolute value to $R_n$ which is the reaction force the ink ribbon receives from the support wall 66, and this reaction force serves to regulate the ink ribbon wound on the take-up spool 61 so that the ink ribbon does not become slack. Further generally $$R_1 \leqq R_n \tag{8}$$

and therefore, $R_1$ is the minimum necessary reaction force for preventing the slack of the take-up spool. Now, the present embodiment is compared with the example of the prior art shown in FIGS. 18 and 19. The minimum necessary reaction force may be considered to be equal in both of FIG. 12 and FIG. 13 and therefore, $$P_1 = R_1 \tag{9}$$

Consequently, $$G_1 \sqrt{1 - \left(\frac{l}{r_1}\right)^2} = F_1 \sqrt{1 - \left(\frac{x - r_1}{S}\right)^2} \tag{10}$$

Generally, $$l < r_1 \tag{11}$$

$$x - r_1 << S \tag{12}$$

From (11) and (12), $$\frac{l}{r_1} > \frac{x - r_1}{S} \tag{13}$$

From (10) and (13), $$G_1 > F_1 \tag{14}$$

Figure 14:
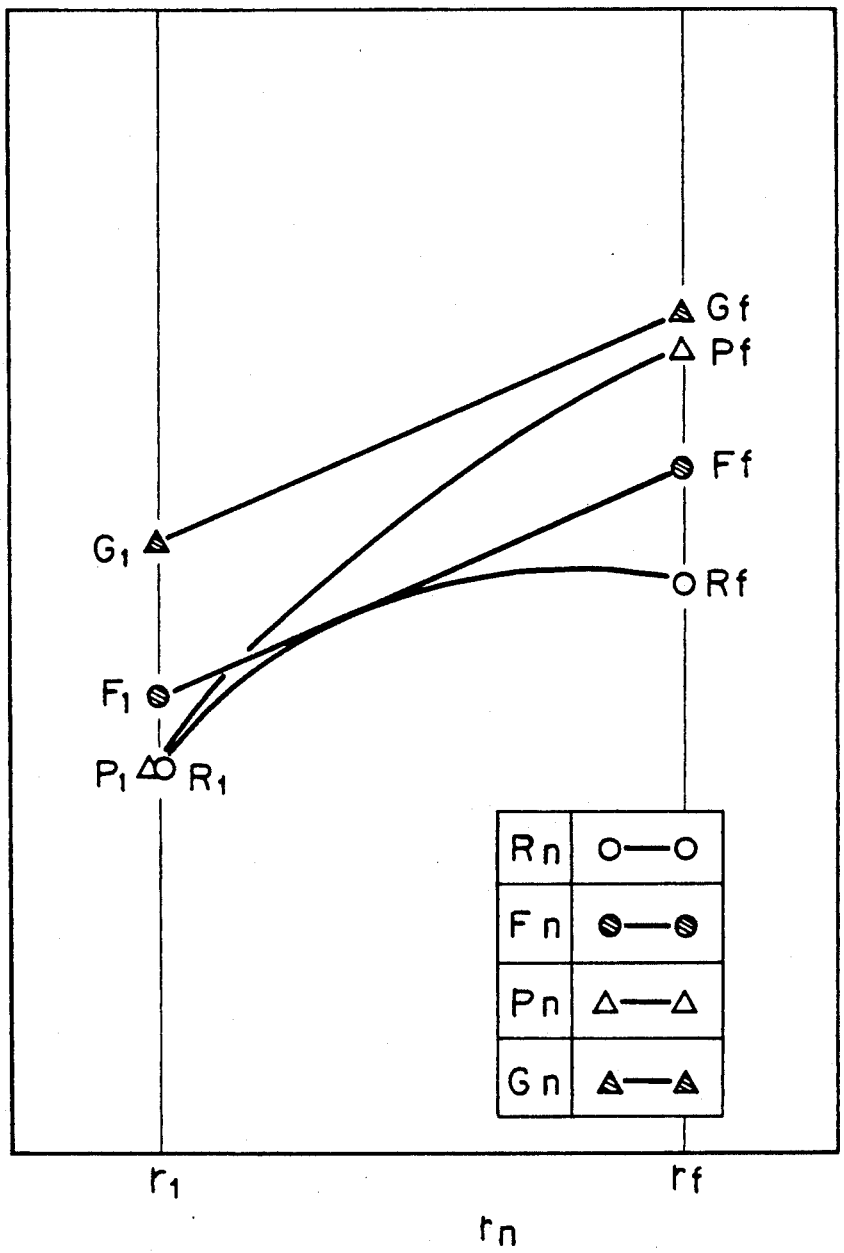
FIG. 14 is a graph illustrating characteristic curves.
Figure 15A:
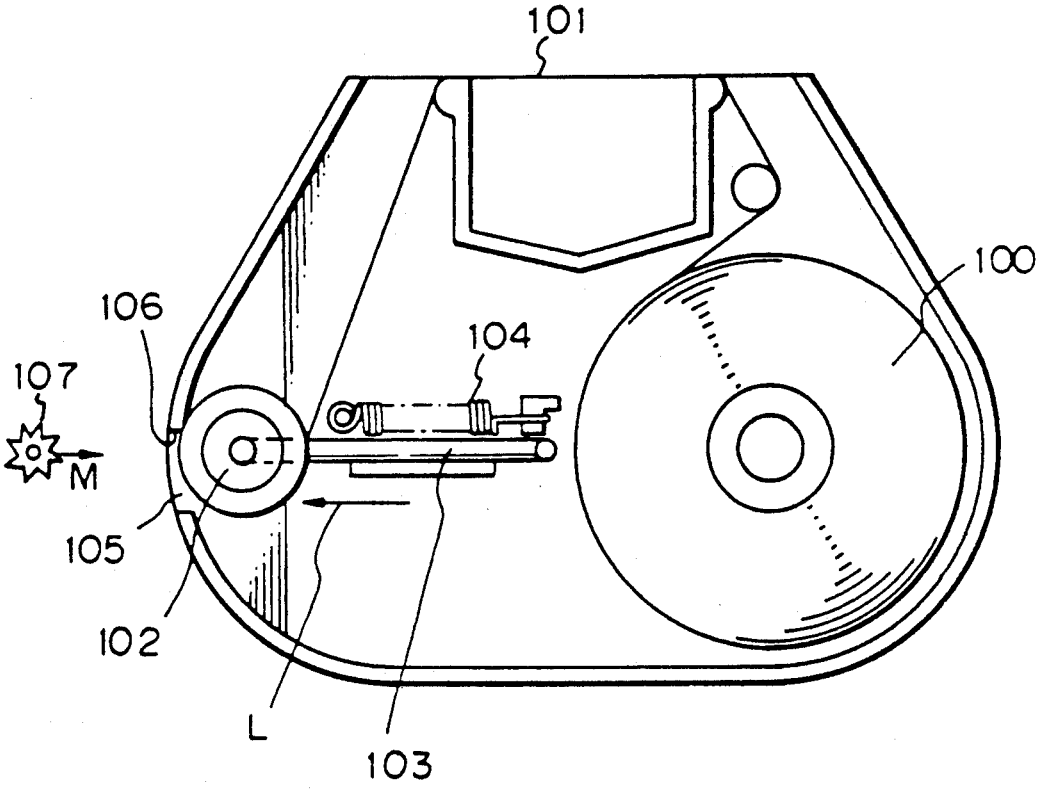
Fig. 15 A PRIOR ART
FIGS. 15A and 15B are plan view and a cross-sectional view, respectively, of an example of the prior art.
Figure 15B:
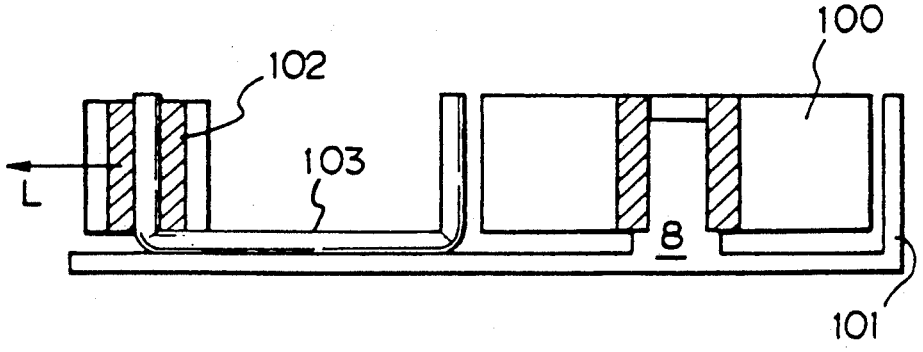
Fig. 15 B PRIOR ART
Figure 16:
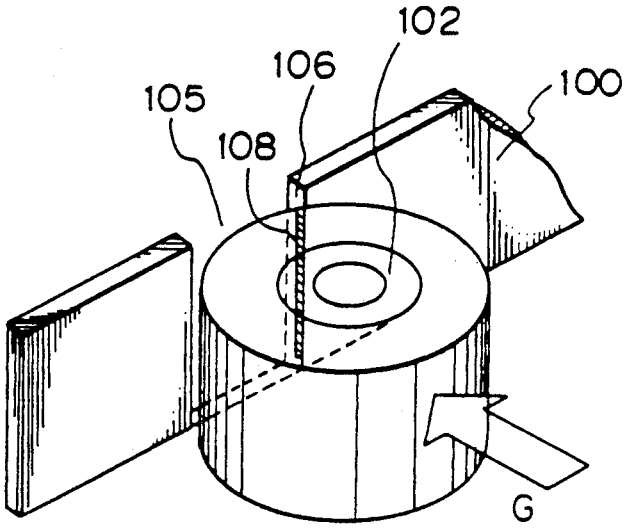
Fig. 16 PRIOR ART
FIG. 16 illustrates the relation between the take-up spool and the opening.
Figure 17:
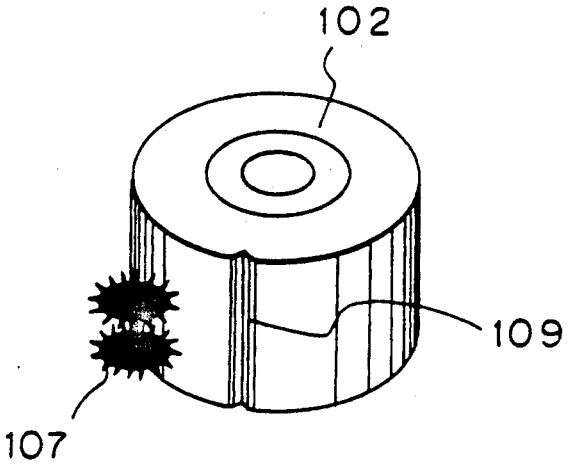
Fig. 17 PRIOR ART
FIG. 17 illustrates an example of the prior-art take-up spool.

A graph in which the relations among $R_n$, $F_n$, $P_n$ and $G_n$ are put in order on the basis of these relations is shown in FIG. 14.

As shown in (14), the spring forces $G_1$ and $F_1$ necessary to produce equal reaction forces $P_1$ and $R_1$ at the initial stage are in the relation that $G_1 > F_1$, and $G_1$ is greater than $F_1$. Thus, in the present embodiment, a spring of small spring constant can be used as the coil spring 47. Accordingly, the strength of the cassette can be reduced and movement of the take-up spool 61 becomes smooth. As the take-up progresses further, $P_n$ becomes more approximate to $G_n$, but $R_n$ has a characteristic that is once assumes the same value as $F_n$ and then again becomes far therefrom. Thus, it becomes difficult for the stepped portion 68 shown in FIG. 6 to be formed. Further, the force acting between the ribbon feed tooth and the ribbon is $G_n$ in the case of the prior art, and is rather approximate to $R_n$ in the present embodiment. In the present embodiment, the amount of the feed tooth eating into the ribbon is generally smaller and the rate of increase is also very low. Thus, the eat-in force acting between the take-up spool 61 and the feed tooth 22 becomes approximately uniform, and the variation in the amount of feed of the ribbon becomes very small relative to the variation in the amount of turns of the spool 61. Also, the ribbon itself is not injured more than necessary and the take-up property thereof becomes good.

We claim:

1. An ink ribbon cassette removably mountable on a recording apparatus, comprising:

(a) a frame;

(b) an ink ribbon;

(c) a first spool for holding said ink-ribbon;

(d) a second spool for taking up said ink-ribbon, said second spool being movably supported and the ink ribbon on said second spool having a first area and a second area, wherein said first area is the upper half of said ink ribbon;

(e) biasing means for biasing said second spool in a predetermined direction; and (f) restriction means for, when said ink ribbon cassette is mounted on said recording apparatus, engaging said first area of said ink ribbon, said first area being mutually exclusive from said second area, said second area being a location to which an ink ribbon feeding force is applied by said recording apparatus, said restricting means thereby restricting shifting of said second spool, said restriction means being comprised of a support wall that engages only the first area.

2. The ink ribbon cassette of claim 1, wherein the second area is the lower half of the ink ribbon and said ribbon feeding force is comprised of feed teeth positioned to engage only the second area.

3. An ink ribbon cassette removably mountable on a recording apparatus, comprising:

(a) a frame;

(b) an ink ribbon;

(c) a first spool for holding said ink-ribbon;

(d) a second spool for taking up said ink-ribbon, said second spool being movably supported and the ink ribbon on said second spool having a first area and a second area;

(e) biasing means for biasing said second spool in a predetermined direction; and (f) restriction means for, when said ink ribbon cassette is mounted on said recording apparatus, engaging said first area of said ink ribbon, said first area being mutually exclusive from said second area, said second area being a location to which an ink ribbon feeding force is applied by said recording apparatus, said restricting means thereby restricting shifting of said second spool, said restriction means being comprised of a support wall having two apertures and a bar between said apertures, said being bar at a height on the support wall so as to engage the central portion of the ink ribbon.

4. An ink ribbon cassette removably mountable on a recording apparatus, comprising:

(a) an ink ribbon;

(b) supply means for supplying said ink ribbon;

(c) a take-up spool for taking up said ink ribbon, said take-up spool being movably supported;

(d) elastic means for biasing said take-up spool in a predetermined direction by elastic force;

(e) a case for enclosing said supply means and said take-up spool, said case including an aperture through which, when said ink ribbon cassette is mounted on said recording apparatus, said ink ribbon engages a transfer means for rotating the take-up spool; and (f) restriction means provided above said aperture for restricting shifting of said take-up spool, said restriction means contacting an area of the ink ribbon on the take-up spool different from an area of the ink ribbon on the take-up spool that contacts said transfer means, wherein said restriction means is comprised of a support wall that engages only an upper half of said ink ribbon on the take-up spool.

5. An ink ribbon cassette removably mountable on a recording apparatus, comprising:

(a) an ink ribbon;

(b) a supply ribbon spool for supplying said ink ribbon;

(c) a take-up ink ribbon spool for taking-up said ink ribbon, said take-up ink ribbon spool having a moveable center of axis;

(d) biasing means for supplying a biasing force to said take-up ribbon spool;

(e) a cassette case containing therein said supply ink ribbon spool and said take-up ink ribbon spool and having an aperture on a side wall, said aperture having a height less than the width of said ink ribbon, through which, when said ink ribbon cassette is mounted on said recording apparatus, a feeding member provided in said recording apparatus engages said ink ribbon to apply a feeding force to said ink ribbon; and (f) restriction means for restricting shifting of said take-up side ink ribbon spool by engaging an area of said ink ribbon which is different from an area of said ink ribbon said feeding force engages.

6. An ink ribbon cassette according to claim 5, wherein a part of a side wall of said ink ribbon cassette serves as said restriction means.

7. An ink ribbon cassette according to claim 5, wherein said biasing means comprises a torsion coil spring.

8. An ink ribbon cassette according to claim 5, wherein said biasing means comprises a torsion coil spring and said restriction means comprises a part of a side wall of said ink ribbon cassette.

9. A recording apparatus having a removably mountable ink ribbon cassette thereon, comprising:

(a) rotation means for supplying a force to take up an ink ribbon; and (b) a mounting means for mounting an ink ribbon cassette, said ink ribbon cassette including:

(b-1) a frame;

(b-2) an ink ribbon;

(b-3) first spool means for winding said ink ribbon;

(b-4) second spool means for taking-up said ink ribbon, said second spool means being movably supported;

(b-5) biasing means for biasing said second spool means in a predetermined direction; and (b-6) restriction means for restricting shifting of said second spool means by engaging an area of said ink ribbon different from any portion of said ink ribbon that said rotation means engages, wherein said restriction means comprises a side wall of said frame and said side wall contains an aperture beginning at the bottom of the side wall and extending upward no more than one-half of a width of the ink ribbon.

10. A recording apparatus having a removably mountable ink ribbon cassette thereon, comprising:

(a) rotation means for supplying a force to take up an ink ribbon; and (b) a mounting means for mounting an ink ribbon cassette, said ink ribbon cassette including:

(b-1) a frame;

(b-2) an ink ribbon;

(b-3) first spool means for winding said ink ribbon;

(b-4) second spool means for taking-up said ink ribbon, said second spool means being movably supported;

(b-5) biasing means for biasing said second spool means in a predetermined direction; and (b-6) restriction means for restricting shifting of said second spool means by engaging an area of said ink ribbon different from any portion of said ink ribbon that said rotation means engages, wherein said restriction means comprises a side wall of said frame, said side wall contains two apertures positioned generally one over the other and said apertures are separated by a horizontal bar which is integrally connected to said side wall.

11. A recording apparatus having a removably mountable ink ribbon cassette thereon, comprising:

(a) rotation means for supplying a force to take-up an ink ribbon on a spool; and (b) mounting means for mounting an ink ribbon cassette, said ink ribbon cassette including:

(b-1) an ink ribbon;

(b-2) a take up spool for taking-up said ink ribbon, said take-up spool being movably supported;

(b-3) an elastic means for biasing said take up spool in a predetermined direction by elastic force;

(b-4) a case for enclosing said take-up spool and ink ribbon, said case including an aperture through which, when said ink ribbon cassette is mounted on said recording apparatus, said rotation means contacts said ink ribbon; and (b-5) restriction means above said aperture for restricting shifting of said take-up spool by engaging an area of said ink ribbon different from an area of said ink ribbon said rotation means engages.

12. A recording apparatus according to claim 11, wherein said rotation means comprises rotating feed teeth.

13. A recording apparatus according to claim 11, wherein said mounting means comprises a pivotable mounting bed.

14. A recording apparatus according to claim 11, wherein said elastic means comprises a torsion coil spring.

15. A recording apparatus according to claim 11, wherein said restriction means comprises a part of a side wall of said ink ribbon cassette case.

16. A recording apparatus according to claim 11, wherein said rotation means comprises rotating feed teeth, said mounting means comprises a pivotable mounting bed, said elastic means comprises a torsion coil spring, and said restriction means comprises a part of a side wall of said ink ribbon cassette case.

* * * * *

UNITED STATES PATENT AND TRADEMARK OFFICE

CERTIFICATE OF CORRECTION

PATENT NO. : 5,044,794

DATED : September 3, 1991

INVENTOR(S) : NOBORU SHIMOYAMA, ET AL.

It is certified that error appears in the above-identified patent and that said Letters Patent is hereby corrected as shown below:

ON THE TITLE PAGE

Item [57], Abstract

Line 11, "impart" should read --imparts--.

COLUMN 6:

Line 3, "support shaft 52" should read --support shaft 53--.

COLUMN 10:

Line 4, "being bar" should read --bar being--;

Line 34, "having a" should read --being movably supported;--;

Line 35, "moveable center of axis;" should be deleted;

Line 48, "side" should be deleted;

Line 66, "for mounting" should read --for removably mounting--.

COLUMN 11:

Line 21, "for mounting" should read --for removably mounting--.

UNITED STATES PATENT AND TRADEMARK OFFICE

CERTIFICATE OF CORRECTION

PATENT NO. : 5,044,794

DATED : September 3, 1991

INVENTOR(S) : NOBORU SHIMOYAMA, ET AL.

It is certified that error appears in the above-identified patent and that said Letters Patent is hereby corrected as shown below:

COLUMN 12:

Line 5, "for mounting" should read --for removably mounting--;

Line 8, "take up" should read --take-up--;

Line 10, "take up" should read --take-up--.

Signed and Sealed this

Twenty-ninth Day of June, 1993

*Attest:*

Michael K. Kirk

MICHAEL K. KIRK

*Attesting Officer*

*Acting Commissioner of Patents and Trademarks*